US008220074B2

(12) United States Patent
Sutker

(10) Patent No.: US 8,220,074 B2
(45) Date of Patent: Jul. 17, 2012

(54) GARMENT CONFIGURED FOR SELECTIVE ACCOMMODATION OF HEATING OR COOLING PACKS

(75) Inventor: Lisa Sutker, Savannah, GA (US)

(73) Assignee: Lisa Sutker, Savannah, GA (US)

( * ) Notice: Subject to any disclaimer, the term of this patent is extended or adjusted under 35 U.S.C. 154(b) by 804 days.

(21) Appl. No.: 12/041,084

(22) Filed: Mar. 3, 2008

(65) Prior Publication Data

US 2009/0217440 A1 Sep. 3, 2009

(51) Int. Cl.
*A41D 27/20* (2006.01)
*A41D 13/00* (2006.01)

(52) U.S. Cl. ..... 2/69; 2/247; 2/251

(58) Field of Classification Search ..... 2/69, 267, 2/268, 97, 463, 2.94, 102, 88, 247, 251; 450/36–39, 450/54–58, 1; 607/108–110
See application file for complete search history.

(56) References Cited

U.S. PATENT DOCUMENTS

| | | | | | |
|---|---|---|---|---|---|
| 4,033,354 | A | | 7/1977 | DeRosa | |
| 4,625,729 | A | * | 12/1986 | Roney | 607/108 |
| 5,038,779 | A | * | 8/1991 | Barry et al. | 607/108 |
| 5,086,629 | A | * | 2/1992 | Dibrell | 62/259.3 |
| 5,187,814 | A | * | 2/1993 | Gold | 2/160 |
| 5,271,211 | A | * | 12/1993 | Newman | 54/79.2 |
| 5,302,806 | A | * | 4/1994 | Simmons et al. | 219/211 |
| 5,375,261 | A | | 12/1994 | Lipke | |
| 5,484,448 | A | | 1/1996 | Steele et al. | |
| 5,537,954 | A | * | 7/1996 | Beeghly et al. | 119/850 |
| 5,605,144 | A | | 2/1997 | Simmons et al. | |
| 5,652,961 | A | | 8/1997 | Knight-Yurt | |
| 5,787,505 | A | * | 8/1998 | Piwko et al. | 2/115 |
| 5,970,519 | A | | 10/1999 | Weber | |
| 5,977,519 | A | | 11/1999 | Sorensen et al. | |
| 6,185,742 | B1 | | 2/2001 | Doherty | |
| 6,993,930 | B2 | | 2/2006 | Blackstone | |
| 7,043,765 | B1 | | 5/2006 | Otsubo | |
| 7,739,748 | B2 | * | 6/2010 | Nilforushan et al. | 2/69 |
| 2002/0062509 | A1 | | 5/2002 | Bulla | |
| 2006/0036304 | A1 | | 2/2006 | Cordani et al. | |
| 2006/0253954 | A1 | | 11/2006 | Music | |
| 2008/0201818 | A1 | * | 8/2008 | Nilforushan et al. | 2/69 |

* cited by examiner

*Primary Examiner* — Gloria Hale
(74) *Attorney, Agent, or Firm* — Philip H. Burrus, IV

(57) ABSTRACT

A garment (100) for selectively warming or cooling a wearer includes a layer of material (101) with one or more pockets (201, 202, 203) coupled thereto. The one or more pockets (201, 202, 203) are configured to selectively receive one or more heating or cooling packs (500). In one embodiment, the one or more pockets (201, 202, 203) include a thermal adjustment layer (405), which may be configured as a thermal adjustment pocket (406), or a foldable layer of material (706). At least a portion of the thermal adjustment layer (405) may be selectively placed either between the one or more heating or cooling packs (204) and the wearer, or between the one or more heating or cooling packs (204) and an outer pocket portion (301) of a pocket (300). The one or more pockets (201, 202, 203) may be detachable from the garment (100), and may be of the same or different material as that of the garment (100).

73 Claims, 4 Drawing Sheets

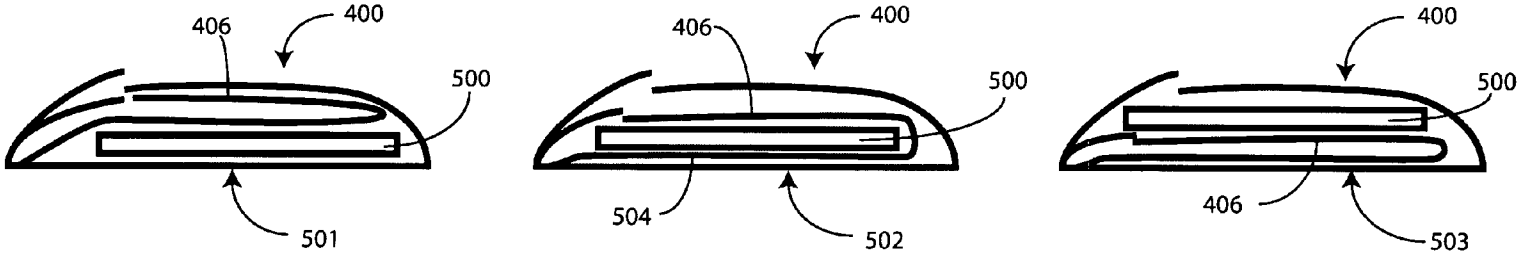
FIG. 5
FIG. 6
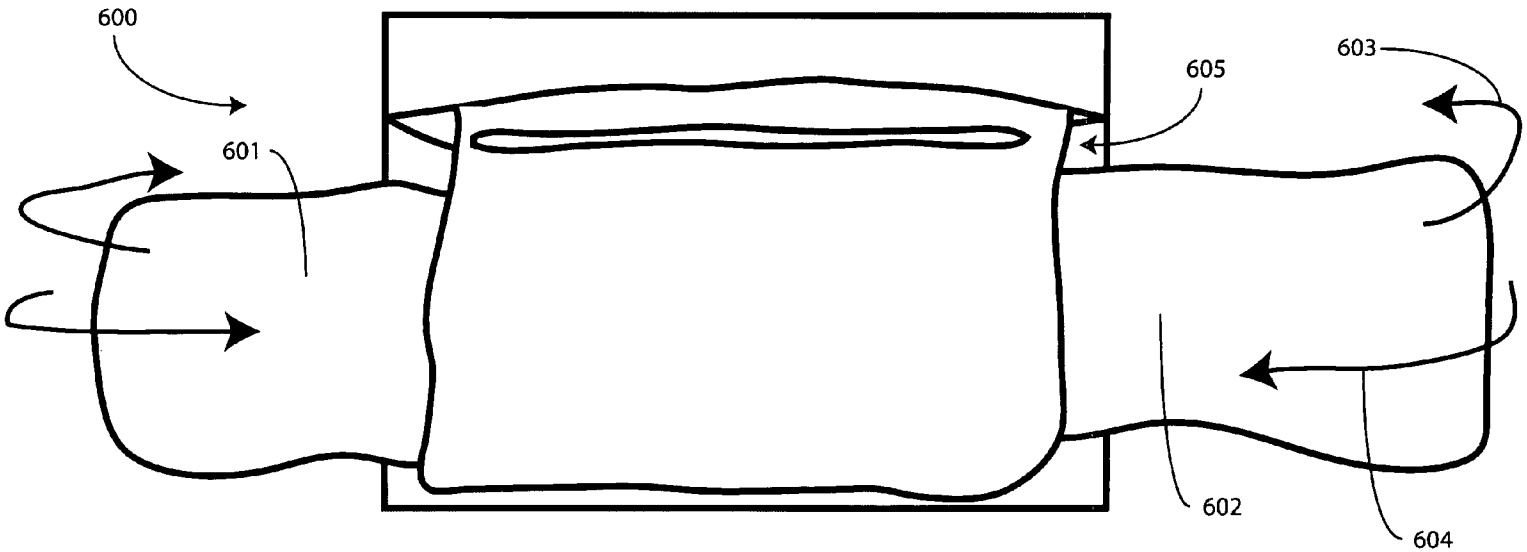

GARMENT CONFIGURED FOR SELECTIVE ACCOMMODATION OF HEATING OR COOLING PACKS

BACKGROUND

1. Technical Field

This invention relates generally to garments capable of selectively warming or cooling a user, and more specifically to a garment, such as a surgical scrub shirt, having pockets or other means for accommodating the insertion of heating or cooling packs in selected areas for the localized application of heating or cooling.

2. Background Art

The ambient temperatures of some work environments are beyond a worker's control, and can be quite uncomfortable. By way of example, a surgeon working in an operating room may have little control over room temperature. Other factors, including the needs of the patient, or required ambient temperatures for operating equipment, may take priority over the surgeon's comfort. Further compounding matters, the stress of surgery may exacerbate the perception of temperature by the surgeon, thereby making it "feel" hotter or colder that it actually is.

To make matters worse, while the worker may have little control over the ambient temperature, they may also have little control over their own wardrobe. Many workers, for example, are required to wear a particular uniform. As such, these workers are unable to simply "put on a sweater" or change to a "lighter weight shirt," as this would deviate from the uniform specifications. Turning back to the example of the surgeon, most doctors in operating rooms wear "scrubs" which are thin, lightweight, cotton garments. When a doctor wearing scrubs feels too hot, there is little option for lighter, thinner clothing.

There is thus a need for an improved garment capable of selectively heating or cooling a wearer.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

FIG. 5 illustrates elevation, cut-away views of various placement locations of one or more heating or cooling packs within a pocket having a thermal adjustment layer in accordance with embodiments of the invention.

FIG. 6 illustrates one embodiment of a pocket having a thermal adjustment layer in accordance with the invention, wherein the thermal adjustment layer includes wings emanating from the thermal adjustment layer.

Figure 1:
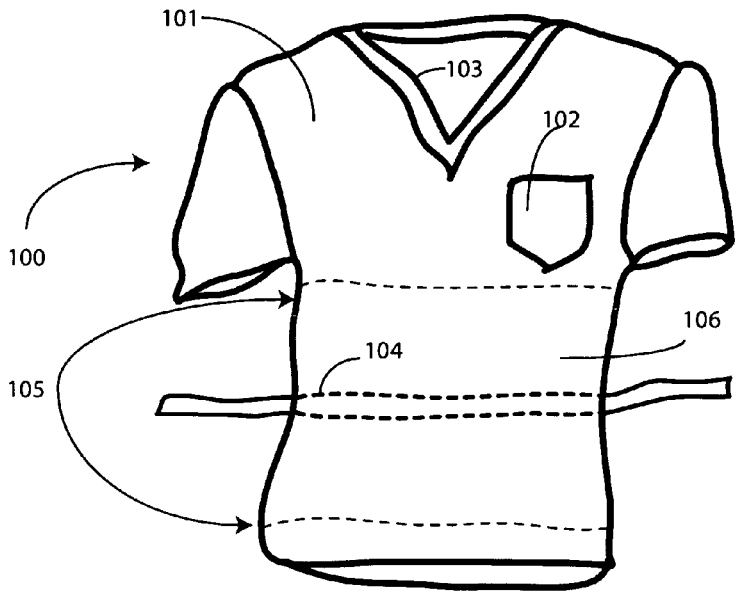
FIG. 1 illustrates a front plan view of a garment for selectively warming or cooling a wearer in accordance with embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE INVENTION

Before describing in detail embodiments that are in accordance with the present invention, it should be observed that the embodiments reside primarily in combinations apparatus components related to a shirt, such as a surgical scrub shirt, having one or more pockets configured to selectively receive one or more heat packs or cooling packs for heating or cooling a wearer. Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

Embodiments of the invention are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

Embodiments of the present invention relate to a garment, such as a shirt, having one or more pockets for selectively receiving one or more heating packs or cooling packs. The heating packs or cooling packs can be used to selectively warm or cool the wearer. By way of example, where the wearer generally feels "hot", cooling packs may be disposed within the pockets to cool the wearer. Where the user feels "cold", heating packs may be disposed within the pockets to selectively warm the wearer.

While general warming or cooling is one effect, embodiments of the present invention may be used for therapeutic warming or cooling as well. For instance, where the wearer is a surgeon, and the garment is a scrub shirt, the surgeon may use various pockets for different purposes. The stress and strain of surgery, for example, may lead to fatigue in some body parts, such as the shoulders. Simultaneously, the surgeon may be working in a hot operating room. In one embodiment, the surgeon may use certain pockets for cooling, such as a large pocket disposed across his upper back. The surgeon—or a nearby assistant—would place one or more cooling packs in this pocket for general cooling. The surgeon may also desire to relieve the tension in the shoulders. As such, the surgeon or assistant may place heating packs in pockets disposed along a shoulder region to provide a therapeutic heat source to the sore muscles.

Note that while the therapeutic aspects as they apply to a surgeon's scrub shirt are only one exemplary application of embodiments of the invention. Numerous other occupations may find the therapeutic aspects desirable as well. For example, occupations where manual labor is involved, such as lifting and moving objects, may find the therapeutic application desirable. There are many occupations for which embodiments of the present invention are applicable.

To assist in regulating the amount of heating or cooling applied to the wearer, in one embodiment the various pockets of the garment include a thermal adjustment layer. This thermal adjustment layer, which can be another pocket itself, a foldable layer of material, or other suitable structure, may be placed in varying locations relative to the heating or cooling pack as to help with temperature regulation. For instance, in one mode the thermal adjustment layer may be placed beneath the heating or cooling pack to reduce the amount of heating or cooling felt by the wearer. When the thermal adjustment layer is moved atop the heating or cooling pack, the wearer experiences increased thermal sensation, as fewer layers of material are disposed between the heating or cooling pack and the wearer's body.

For simplicity of discussion in this specification, the garment described herein will be that of a surgeon's scrub shirt. This example works well because one application for embodiments of the invention is to warm and cool a doctor or nurse working in the operating room. Doctors and nurses performing operations often are called to stand in relatively stationary positions for extended periods of time. Further, actual or perceived operating room temperatures can be quite high. As such, garments in accordance with embodiments of the invention may be used to generally cool the wearer in such an environment. Optionally, some pockets can be used to warm select portions of the wearer, for example to ease sore muscles.

While a surgeon's scrub shirt will be used as an exemplary embodiment, it is an illustrative embodiment only. It will be clear to those of ordinary skill in the art having the benefit of this disclosure that the invention is not so limited. Numerous other occupations are well suited for garments in accordance with embodiments of the invention. Further, elements described herein, including pockets and thermal adjustment layers, may be applied to different types of garments, including pants, outerwear, hats, and so forth.

Turning now to FIG. 1, illustrated therein is one embodiment of a garment 100 for selectively warming or cooling a wearer in accordance with the invention. The illustrative garment 100 of FIG. 1 is that of a surgical scrub shirt. The garment 100 can be made of a variety of materials, including cotton, wool, polyester, synthetics, blends, and other materials known in the art of textiles.

The garment 100 includes a layer of material 101 that defines the garment 100. The layer of material 100 forms the body of the garment 100. In the exemplary embodiment of FIG. 1, the layer of material 100 forms a shirt. Where the garment 100 is a surgical scrub shirt, exemplary textiles for the layer of material 101 include cotton or a cotton-polyester blend.

The garment 100 may include one or more generalized pockets 102 for holding common items. These generalized pockets 102 may be placed in conventional, easy to reach locations, such as atop the right breast.

Where the garment 100 is for a specialized purpose, other design characteristics may be included. As the garment 100 shown in FIG. 1 is that of a surgical scrub shirt, the garment 100 includes a low, scooped v-neck 103 that allows a wearer to comfortably move neck and arms without any binding from the garment 100.

In one embodiment, the garment 100 includes a cinching mechanism 104. While the function of the optional cinching mechanism 104 will be described in more detail below, one application of the cinching mechanism 104 is cinching or tightening a section 105 of the garment 100 about a wearer's torso. Where the garment 100 is a surgical scrub shirt, surgeons may desire such a feature, for example, so as not to have the front 106 of the garment 100 dangling across the patient.

Figure 2:
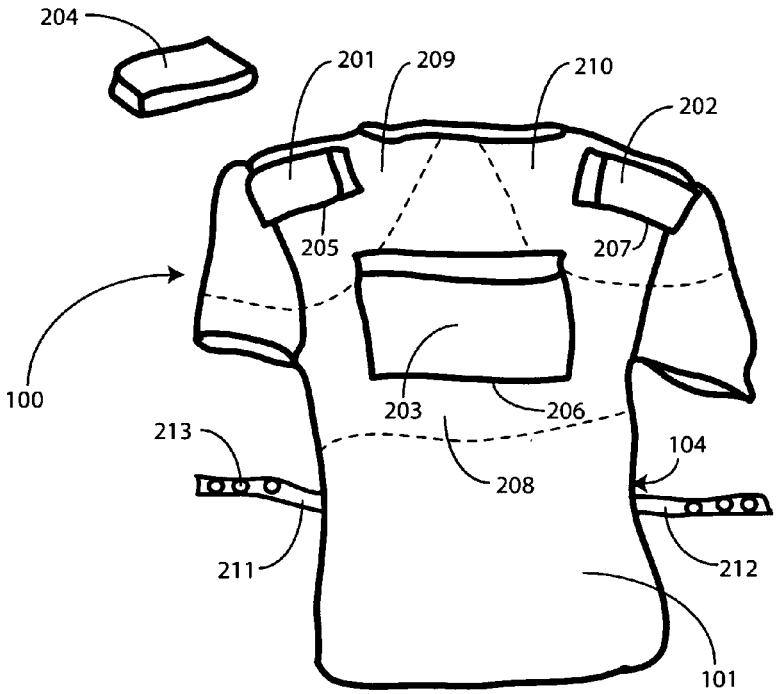
FIG. 2 illustrates a rear plan view of a garment for selectively warming or cooling a wearer in accordance with embodiments of the invention.

Turning now to FIG. 2, illustrated therein is a rear plan view of one embodiment of a garment 100 for selectively warming or cooling a wearer in accordance with the invention. As can be seen from FIG. 2, in one embodiment, the garment 100 includes one or more pockets 201,202,203 disposed along the layer of material 101. In contrast to the generalized pocket (102), the one or more pockets 201, 202, 203 shown in FIG. 2 are designed to selectively receive one or more heating or cooling packs 204. More to the point, in one embodiment, the one or more pockets 201,202,203 are configured to receive one or more heating packs or cooling packs 204 so as to selectively warm or cool the wearer.

Each of the one or more pockets 201, 202, 203, in one embodiment, includes an outer pocket portion 205,206,207, which can be a textile that is the same as the layer of material 101. Alternatively, the outer pocket portion 205, 206, 207 can be a different layer of material. For instance, where unity and consistency of appearance is desired, the same textile—such as a cotton-poly blend—may be used for the layer of material 101 and the outer pocket portion 205,206,207. Where a specific function is desired, the outer pocket portion 205,206,207 may be constructed of a different material. As an example, the layer of material 101 may be a cotton-poly blend while the outer pocket portion 205, 206, 207 can be a water repellant or water absorbent material, and so forth.

The outer pocket portion 205, 206, 207 can be permanently or detachably affixed to the layer of material 101. In one embodiment, the outer pocket portion 205,206,207 is fixedly coupled to the layer of material 101, such as by stitching or sewing the outer pocket portion 205,206,207 to the layer of material 101. In another embodiment, the one or more pockets 201,202,203 are detachable from the layer of material 101. As such, the one or more pockets 201,202,203—and the corresponding outer pocket portion 205, 206, 207—can be coupled to the layer of material by a coupling mechanism such as a hook and loop connector.

The one or more pockets 201,202,203 may be placed on any area of the garment 100. While the exemplary one or more pockets 201, 202, 203 of FIG. 2 are placed on the back of the garment 100, which is one suitable location for a surgical scrub shirt, it will be clear to those of ordinary skill in the art having the benefit of this disclosure that the invention is not so limited. Pockets configured to selectively receive heating or cooling packs may be placed on the front, sides, or inside of the garment as well.

In one embodiment, suitable for surgical applications, the one or more pockets 201,202,203 include at least three pockets. In the exemplary embodiment of FIG. 2 for instance, there are three pockets. Anecdotal evidence has shown that placing the pockets in certain locations, for surgical applications, can be beneficial to the wearer. For instance, surgeon's shoulders sometimes become fatigued after long hours of surgery. Similarly, surgeons frequently get hot in the operating room.

To address both of these concerns, in one embodiment the garment 100 defines an upper back portion 208, a first shoulder portion 209, and a second shoulder portion 210. Pocket 201 is disposed in the first shoulder portion 209, while pocket 202 is disposed in the second shoulder portion 210. Pocket 203 is disposed in the upper back portion 208. In this exemplary embodiment, a cooling pack can be placed in the large pocket 203 to generally cool the wearer. Heating packs can be placed in the one or more pockets 201, 202 to selectively apply heat to the sore shoulders.

As noted briefly in the discussion of FIG. 1, in one embodiment the garment 100 includes a cinching mechanism 104 that can be used to cinch a section of the garment 100 about a wearer's torso. In FIG. 2, the ends 211, 212 of the cinching mechanism 104 can be seen. The cinching mechanism 104 can be any of a variety of devices, including drawstrings, ties passing through loops of material, elastic, and so forth. In one embodiment, the ends 211, 212 of the cinching mechanism 104 include a fastener 213 for adjustably coupling the ends 211, 212 together. Any number of fasteners can be used with the cinching mechanism 104, including buttons, zippers, drawstring ties, or hook and loop type connectors. Note that while one cinching mechanism 104 is shown, multiple cinching mechanisms may be employed to provide a more tailored cinch about the wearer. Additionally, cinching mechanisms can be used along other portions of the garment, such as about the sleeves, about the neck, or from shoulder to shoulder.

Figure 3:
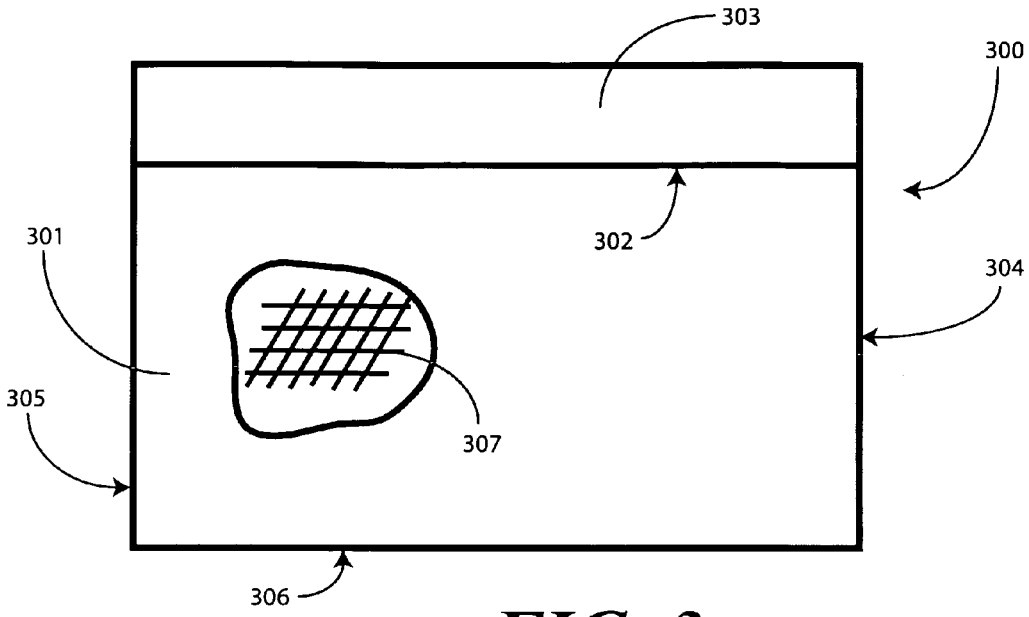
FIG. 3 illustrates one embodiment of a pocket configured to selectively receive one or more heat packs or cooling packs in accordance with embodiments of the invention.

Turning now to FIG. 3, illustrated therein is one embodiment of a pocket 300 for selectively receiving one or more heat packs or cooling packs in accordance with the invention. The pocket 300 of FIG. 3 is but one configuration of pockets that may be used with the invention, and others will be described in further detail below.

The illustrative pocket 300 of FIG. 3 includes an outer pocket portion 301 and an opening cover 303. The separation between the outer pocket portion 301 and the opening cover 303 defines an opening 302 configured to receive the one or more heating or cooling packs. While the opening 302 in FIG. 3 is generally across the top of the pocket 300, it will be clear to those of ordinary skill in the art having the benefit of this disclosure that the invention is not so limited. The opening 302 may be placed on either side 304,305 of the pocket 300, or on the bottom 306 of the pocket 300. A closing mechanism, which will be described in more detail below, may be desired in such locations.

In one embodiment, the opening cover 303 comprises a cover layer of material overlapping the outer pocket portion 301. This overlapping arrangement helps to ensure that heating or cooling packs remain securely within the pocket 300.

As noted above, the pocket 300 may be constructed of material that is the same as, or different from, the material of the garment (100). Further, the pocket 300 may be lined or otherwise may include specific materials. By way of example, the illustrative pocket 300 of FIG. 3 includes a water absorbent lining 307 configured to collect water that may arise due to condensation on cooling packs disposed within the pocket 300.

Figure 4:
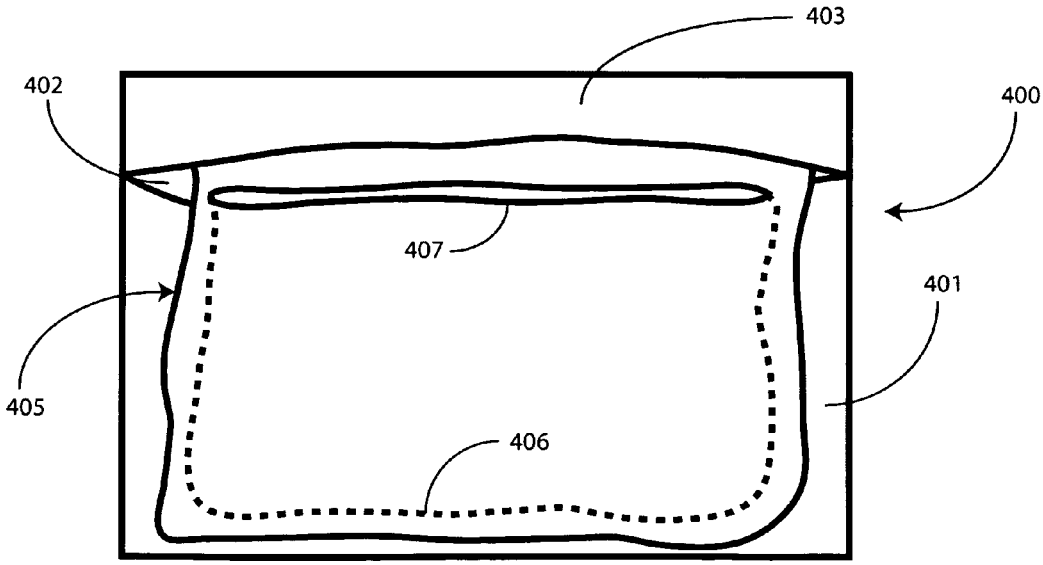
FIG. 4 illustrates one embodiment of a pocket configured to selectively receive one ore more heat packs or cooling packs in accordance with embodiments of the invention, where the pocket includes a thermal adjustment layer in accordance with one embodiment of the invention.

Turning now to FIG. 4, illustrated therein is one embodiment of a pocket 400 configured to receive one or more heating or cooling packs in accordance with the invention. The pocket 400 of FIG. 4 is similar to that of FIG. 3, in that it includes an outer pocket portion 401, and an opening 402. The pocket 400 can optionally include an opening cover 403 as well.

The pocket 400 of FIG. 4 differs from that in FIG. 3 in that it includes a thermal adjustment layer 405. The thermal adjustment layer 405, in one embodiment, is an insert that can be placed in different orientations relative to the heating or cooling pack to provide varying amounts of thermal impedance between the heating or cooling pack and the wearer to assist in regulating the application of heat or cold. Said differently, at least a portion of the thermal adjustment layer 405 can be selectively placed either between the heating and cooling pack and the layer of material forming the garment, or it can be placed between the outer pocket portion 401 and the heating or cooling pack. This will be illustrated in more detail in the discussion of FIG. 5.

While the thermal adjustment layer 405 can take many forms, one illustrative embodiment is shown in FIG. 4. In FIG. 4, the thermal adjustment layer 405 is in the form of a thermal adjustment pocket 406 having an opening 407 capable of receiving one or more heating or cooling packs. When the thermal adjustment layer 405 is configured as a thermal adjustment pocket 406, the one or more heating or cooling packs may be placed in one of three locations within the encompassing pocket 400. First, the one or more heating or cooling packs may be placed beneath the thermal adjustment layer 405, such that the entire thermal adjustment layer 405 sits atop the pack. This provides a high level of heating or cooling to the wearer. Second, the one or more heating or cooling packs may be placed within the thermal adjustment pocket 406, thereby placing a portion of the thermal adjustment layer between the one or more heating or cooling packs and the wearer, thereby impeding the heating or cooling function. Third, the one or more heating or cooling packs may be placed atop the thermal adjustment layer, such that all layers of the thermal adjustment layer are disposed between the one or more heating packs and the wearer. This further reduces the delivery of heat or cold to the wearer.

Turning now to FIG. 5, illustrated therein are sectional views of a pocket 400 having one or more heating or cooling packs 500 disposed therein, with a thermal adjustment pocket 406 disposed in varying locations. In view 501, the one or more heating or cooling packs 500 have been placed beneath the thermal adjustment pocket 406. As such, all layers of the thermal adjustment pocket 406 are above the one or more heating or cooling packs 500. Thus, high heating or cooling is delivered to the wearer.

In view 502, the one or more heating or cooling packs 500 have been placed within the thermal adjustment pocket 406. As such, one layer 504 of the thermal adjustment pocket 406 is disposed between the one or more heating or cooling packs 500 and the wearer. This layer 504 provides thermal impedance to reduce the application of warming or cooling.

In view 503, the one or more heating or cooling packs 500 have been placed atop the thermal adjustment pocket 406, thereby placing all layers of the thermal adjustment pocket 406 between the one or more heating or cooling packs 500 and the wearer. This additional thermal impedance further reduces the effect of warming or cooling felt by the wearer.

Turning now to FIG. 6, illustrated therein is an alternate embodiment of a pocket 600 having a thermal adjustment layer 605 in accordance with the invention. In FIG. 6, the thermal adjustment layer 605 comprises a thermal adjustment pocket, as was shown and described with respect to FIG. 4. However, to provide additional thermal regulation capabilities, the thermal adjustment layer 605 includes one or more wing flaps 601,602. These wing flaps 601, 602 may be selectively folded either atop 603, or beneath 604, the thermal adjustment layer 605.

With the configuration of FIG. 6, the one or more heating or cooling packs may be placed in a wider variety of orientations relative to the thermal adjustment layer 605. First, the one or more heating or cooling packs may be placed completely under the beneath the thermal adjustment layer 405, such that the entire thermal adjustment layer 605, as well as both wing flaps 601,602, sits atop the one or more heating or cooling packs. This provides a high level of heating or cooling to the wearer.

Second, the one or more heating or cooling packs may be placed between one of the wing flaps, e.g., wing flap 601, and the thermal adjustment layer 605, thereby providing one layer of material between the one or more heating cooling packs and the garment. This reduces the thermal coupling between the wearer and the one or more heating or cooling packs by a first amount.

Next, where the thermal adjustment layer 605 is a thermal adjustment pocket, the one or more heating or cooling packs may be placed within the thermal adjustment pocket. This configuration provides an additional layer of material between the one or more heating or cooling packs and the wearer when one wing flap, e.g., wing flap 601, is folded beneath the thermal adjustment layer 605, and another wing flap is folded atop the thermal adjustment layer 605. Thus, the thermal coupling between the wearer and the one or more heating or cooling packs by a second amount. Note that when both thermal adjustment layers 601, 602 are folded beneath the thermal adjustment layer 605, thermal coupling is reduced by a third amount.

Third, the one or more heating or cooling packs may be placed atop the thermal adjustment layer 605, thereby reducing the thermal coupling between the one or more heating or cooling packs and the wearer by a fourth amount. One wing flap 601 may be folded beneath the thermal adjustment layer 605 for a fifth amount of thermal coupling reduction. Further, both wing flaps 601,602 may be folded beneath the thermal adjustment layer 605 for a sixth amount of thermal coupling reduction. Other configurations of wing flap/thermal adjustment layer orientations will be obvious to those of ordinary skill in the art having the benefit of this disclosure.

Figure 7:
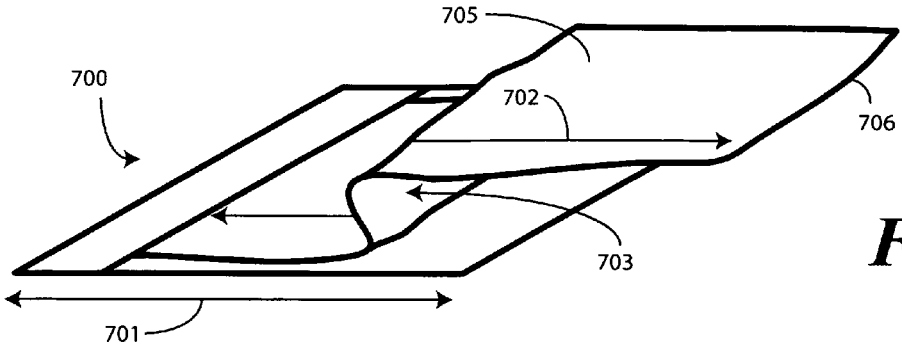
FIG. 7 illustrates one embodiment of a pocket having a foldable thermal adjustment layer in accordance with the invention.

Turning now to FIG. 7, illustrated therein is another embodiment of a pocket 700 configured to selectively receive one or more heating or cooling packs in accordance with the invention. The pocket 700 of FIG. 7 has a thermal adjustment layer 705. However, rather than being configured as a thermal adjustment pocket, the thermal adjustment layer 705 of FIG. 7 comprises a foldable layer of material 706.

By using a foldable layer of material 706 as the thermal adjustment layer 705, thermal regulation is provided by the number of folds disposed between the one or more heating or cooling packs and the wearer.

In one embodiment, the foldable layer of material 706 is characterized by a thermal adjustment layer length 702. To be foldable, and to provide varying levels of thermal adjustment, in one embodiment this thermal adjustment layer length 702 is longer than a pocket length 701. To ensure that the foldable layer of material 706 is capable of covering all of the one or more heating or cooling packs, in one embodiment the foldable layer of material 706 has a thermal adjustment layer length 702 that is at least twice the pocket length 701. In another embodiment, the thermal adjustment layer length 702 is at least three times the pocket length 701.

The thermal adjustment layer 705, in one embodiment, can be folded across a length of the one or more heating or cooling packs. To provide thermal regulation, the thermal adjustment layer 705 can be placed either between the one or more heating or cooling packs and the garment, or between the one or more heating packs and the outer pocket portion. Further, the one or more heating or cooling packs can be placed in various folds, e.g., fold 703, to provide various amounts of thermal adjustment layer material between the one or more heating or cooling packs and the wearer.

Figure 8:
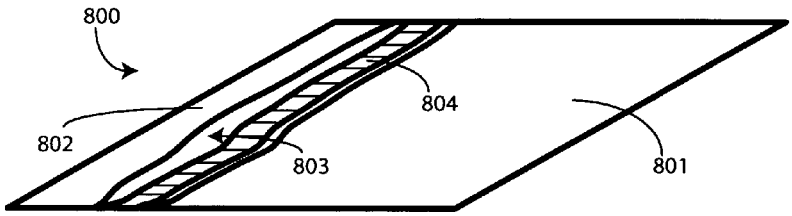
FIG. 8 illustrates a pocket having a closure mechanism in accordance with embodiments of the invention.

Turning now to FIG. 8, illustrated therein is another embodiment of a pocket 800 configured to selectively receive one or more heating or cooling packs in accordance with embodiments of the invention. To ensure that the one or more heating or cooling packs remain within the pocket 800, the pocket 800 of FIG. 8 includes a closure mechanism 804. The closure mechanism 804, which may be placed between the outer pocket portion 801 and the opening cover 802, is used to keep the opening 803 closed. Suitable closure mechanisms 804 include hook and loop connectors, zippers, buttons, snaps, and drawstrings. It will be clear to those of ordinary skill in the art having the benefit of this disclosure that other closure mechanisms may also be used.

Figure 9:
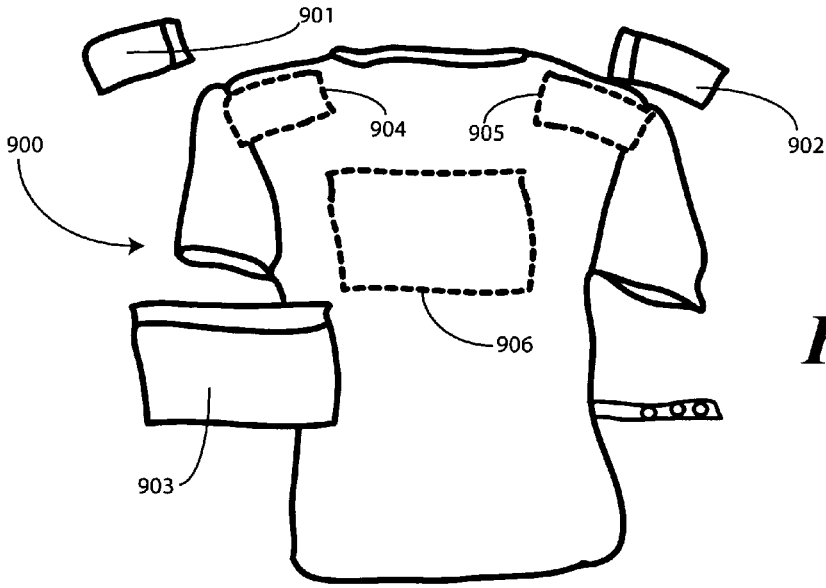
FIG. 9 illustrates a shirt having detachable pockets configured to selectively receive heating or cooling packs in accordance with embodiments of the invention.

Turning now to FIG. 9, illustrated therein is another embodiment of a garment 900 having pockets 901, 902, 903 configured to selectively receive one or more heating or cooling packs in accordance with the invention. In some applications, rather than removing the heating or cooling packs from the pockets, it may be more convenient to simply replace the pockets themselves. By way of example, where the garment 900 is a surgical scrub shirt, a doctor performing surgery may find it inconvenient for an assistant to tug and pull the shirt replacing packs and configuring thermal adjustment layers. It may be more convenient for the assistant to simply configure the pockets with the heating or cooling packs in a remote area, and then to switch out the entire pocket assembly. The garment 900 of FIG. 9 accommodates such a configuration.

In FIG. 9, the pockets 901, 902, 903 are selectively detachable from the garment 900. For instance, the pockets 901, 902, 903 may be coupled to the garment 900 by a removable coupling mechanism 905, 906, 907. The removable coupling mechanism 905,906,907 allows the entire pocket 901, 902, 903 to be removed with the one or more heating packs disposed within. Suitable removable coupling mechanisms 905, 906,907 include zippers, snaps, or hook and loop connecting mechanisms. Other suitable coupling mechanisms may also be used.

In the foregoing specification, specific embodiments of the present invention have been described. However, one of ordinary skill in the art appreciates that various modifications and changes can be made without departing from the scope of the present invention as set forth in the claims below. Thus, while preferred embodiments of the invention have been illustrated and described, it is clear that the invention is not so limited. Numerous modifications, changes, variations, substitutions, and equivalents will occur to those skilled in the art without departing from the spirit and scope of the present invention as defined by the following claims. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims.

What is claimed is:

1. A garment for selectively warming or cooling a wearer, comprising:

a layer of material forming the garment; and one or more pockets disposed along the layer of material and configured to selectively receive one or more heat packs or cooling packs, the one or more pockets comprising an outer pocket portion;

wherein each of the one or more pockets further comprises a thermal adjustment layer, wherein at least a portion of the thermal adjustment layer is placeable in a position of one of between the one or more heat packs or cooling packs and the layer of material or between the one or more heat packs or cooling packs and the outer pocket portion; and wherein the thermal adjustment layer comprises a thermal adjustment pocket, wherein the thermal adjustment pocket is configured to receive the one or more heat packs or cooling packs.

2. The garment of claim 1, wherein the thermal adjustment pocket comprises one or more wing flaps, wherein the one or more wing flaps are foldable either atop or beneath the thermal adjustment pocket.

3. The garment of claim 1, wherein the thermal adjustment layer comprises a foldable layer of material, such that the thermal adjustment layer are foldable across a length of the one or more heat packs or cooling packs, and placed one of between the one or more heat packs or cooling packs and the layer of material or between the one or more heat packs or cooling packs and the outer pocket portion.

4. The garment of claim 3, wherein the one or more pockets comprise a pocket length, wherein the foldable layer of material has a thermal adjustment layer length that is at least twice the pocket length.

5. The garment of claim 4, wherein the thermal adjustment layer length is at least three times the pocket length.

6. The garment of claim 1, wherein the one or more pockets comprise at least three pockets.

7. The garment of claim 6, wherein the garment comprises a shirt, wherein the shirt comprises an upper back portion, a first shoulder portion and a second shoulder portion, wherein a first pocket is coupled to the first shoulder portion, a second pocket is coupled to the second shoulder portion, and a third pocket is coupled to the upper back portion.

8. The garment of claim 1, wherein each of the one or more pockets comprises an opening and an opening cover.

9. The garment of claim 8, wherein the opening is disposed along a top of the one or more pockets.

10. The garment of claim 8, wherein the opening is disposed along a side of the one or more pockets.

11. The garment of claim 8, wherein the opening cover comprises a cover layer of material overlapping the outer pocket portion.

12. The garment of claim 1, wherein the one or more pockets each comprise a closure mechanism.

13. The garment of claim 12, wherein the closure mechanism is selected from the group consisting of hook and loop connectors, zippers, buttons, snaps, and drawstrings.

14. The garment of claim 1, wherein the one or more pockets is selectably detachable from the layer of material, the one or more pockets being selectably coupled to the layer of material by one of a zipper, snap, or a hook and loop connector.

15. The garment of claim 1, wherein the garment further comprises a cinching mechanism configured to cinch a section of the garment about a wearer's torso.

16. The garment of claim 15, wherein the cinching mechanism comprises a fastener selected from the group consisting of buttons, zippers, drawstrings, and hook and loop connectors.

17. The garment of claim 1, wherein each of the one or more pockets comprises a water absorbent lining.

18. The garment of claim 17, wherein the thermal adjustment layer comprises a thermally resistive material.

19. The garment of claim 1, wherein the garment comprises a surgical scrub shirt.

20. A garment for selectively warming or cooling a wearer, comprising:

a layer of material forming the garment; and one or more pockets disposed along the layer of material and configured to selectively receive one or more heat packs or cooling packs, the one or more pockets comprising an outer pocket portion;

wherein each of the one or more pockets further comprises a thermal adjustment layer, wherein at least a portion of the thermal adjustment layer is placeable in one of between the one or more heat packs or cooling packs and the layer of material or between the one or more heat packs or cooling packs and the outer pocket portion; and wherein the thermal adjustment layer comprises a foldable layer of material, such that the thermal adjustment layer is foldable across a length of the one or more heat packs or cooling packs, and placed one of between the one or more heat packs or cooling packs and the layer of material or between the one or more heat packs or cooling packs and the outer pocket portion.

21. The garment of claim 20, wherein the one or more pockets comprise a pocket length, wherein the foldable layer of material has a thermal adjustment layer length that is at least twice the pocket length.

22. The garment of claim 21, wherein the thermal adjustment layer length is at least three times the pocket length.

23. The garment of claim 20, wherein the one or more pockets comprise at least three pockets.

24. The garment of claim 23, wherein the garment comprises a shirt, wherein the shirt comprises an upper back portion, a first shoulder portion and a second shoulder portion, wherein a first pocket is coupled to the first shoulder portion, a second pocket is coupled to the second shoulder portion, and a third pocket is coupled to the upper back portion.

25. The garment of claim 20, wherein each of the one or more pockets comprises an opening and an opening cover.

26. The garment of claim 25, wherein the opening is disposed along a top of the one or more pockets.

27. The garment of claim 25, wherein the opening is disposed along a side of the one or more pockets.

28. The garment of claim 25, wherein the opening cover comprises a cover layer of material overlapping the outer pocket portion.

29. The garment of claim 20, wherein the one or more pockets each comprise a closure mechanism.

30. The garment of claim 29, wherein the closure mechanism is selected from the group consisting of hook and loop connectors, zippers, buttons, snaps, and drawstrings.

31. The garment of claim 20, wherein the one or more pockets is selectably detachable from the layer of material, the one or more pockets being selectably coupled to the layer of material by one of a zipper, snap, or a hook and loop connector.

32. The garment of claim 20, wherein the garment further comprises a cinching mechanism configured to cinch a section of the garment about a wearer's torso.

33. The garment of claim 32, wherein the cinching mechanism comprises a fastener selected from the group consisting of buttons, zippers, drawstrings, and hook and loop connectors.

34. The garment of claim 20, wherein each of the one or more pockets comprises a water absorbent lining.

35. The garment of claim 34, wherein the thermal adjustment layer comprises a thermally resistive material.

36. The garment of claim 20, wherein the garment comprises a surgical scrub shirt.

37. The garment of claim 20, wherein the thermal adjustment layer comprises a thermal adjustment pocket, wherein the thermal adjustment pocket is capable of receiving the one or more heat packs or cooling packs.

38. A garment for selectively warming or cooling a wearer, comprising:

a layer of material forming the garment; and one or more pockets disposed along the layer of material and configured to selectively receive one or more heat packs or cooling packs, the one or more pockets comprising an outer pocket portion;

wherein each of the one or more pockets further comprises a thermal adjustment layer, wherein at least a portion of the thermal adjustment layer is placeable one of between the one or more heat packs or cooling packs and the layer of material or between the one or more heat packs or cooling packs and the outer pocket portion;

wherein the one or more pockets comprise at least three pockets;

wherein the garment comprises a shirt, wherein the shirt comprises an upper back portion, a first shoulder portion and a second shoulder portion, wherein a first pocket is coupled to the first shoulder portion, a second pocket is coupled to the second shoulder portion, and a third pocket is coupled to the upper back portion.

39. The garment of claim 38, wherein the thermal adjustment layer comprises a thermal adjustment pocket, wherein the thermal adjustment pocket comprises one or more wing flaps, wherein the one or more wing flaps are foldable either atop or beneath the thermal adjustment pocket.

40. The garment of claim 38, wherein the thermal adjustment layer comprises a foldable layer of material, such that the thermal adjustment layer is foldable across a length of the one or more heat packs or cooling packs, and placed one of between the one or more heat packs or cooling packs and the layer of material or between the one or more heat packs or cooling packs and the outer pocket portion.

41. The garment of claim 40, wherein the one or more pockets comprise a pocket length, wherein the foldable layer of material has a thermal adjustment layer length that is at least twice the pocket length.

42. The garment of claim 41, wherein the thermal adjustment layer length is at least three times the pocket length.

43. The garment of claim 38, wherein each of the one or more pockets comprises an opening and an opening cover.

44. The garment of claim 43, wherein the opening is disposed along a top of the one or more pockets.

45. The garment of claim 43, wherein the opening is disposed along a side of the one or more pockets.

46. The garment of claim 43, wherein the opening cover comprises a cover layer of material overlapping the outer pocket portion.

47. The garment of claim 38, wherein the one or more pockets each comprise a closure mechanism.

48. The garment of claim 47, wherein the closure mechanism is selected from the group consisting of hook and loop connectors, zippers, buttons, snaps, and drawstrings.

49. The garment of claim 38, wherein the one or more pockets is selectably detachable from the layer of material, the one or more pockets being selectably coupled to the layer of material by one of a zipper, snap, or a hook and loop connector.

50. The garment of claim 38, wherein the garment further comprises a cinching mechanism configured to cinch a section of the garment about a wearer's torso.

51. The garment of claim 50, wherein the cinching mechanism comprises a fastener selected from the group consisting of buttons, zippers, drawstrings, and hook and loop connectors.

52. The garment of claim 38, wherein each of the one or more pockets comprises a water absorbent lining.

53. The garment of claim 52, wherein the thermal adjustment layer comprises a thermally resistive material.

54. The garment of claim 38, wherein the garment comprises a surgical scrub shirt.

55. The garment of claim 38, wherein the thermal adjustment layer comprises a thermal adjustment pocket, wherein the thermal adjustment pocket is configured for receiving the one or more heat packs or cooling packs.

56. A garment for selectively warming or cooling a wearer, comprising:

a layer of material forming the garment; and one or more pockets disposed along the layer of material and configured to selectively receive one or more heat packs or cooling packs, the one or more pockets comprising an outer pocket portion;

wherein each of the one or more pockets further comprises a thermal adjustment layer, wherein at least a portion of the thermal adjustment layer is selectively placeable one of between the one or more heat packs or cooling packs and the outer pocket portion; and wherein the one or more pockets is selectably detachable from the layer of material, the one or more pockets being selectably coupled to the layer of material by one of a zipper, snap, or a hook and loop connector.

57. The garment of claim 56, wherein the thermal adjustment layer comprises a thermal adjustment pocket wherein the thermal adjustment pocket is configured for receiving the one or more heat packs or cooling packs.

58. The garment of claim 56, wherein the thermal adjustment layer comprises a foldable layer of material, such that the thermal adjustment layer is foldable across a length of the one or more heat packs or cooling packs, and placed one of between the one or more heat packs or cooling packs and the layer of material or between the one or more heat packs or cooling packs and the outer pocket portion.

59. The garment of claim 58, wherein the one or more pockets comprise a pocket length, wherein the foldable layer of material has a thermal adjustment layer length that is at least twice the pocket length.

60. The garment of claim 59, wherein the thermal adjustment layer length is at least three times the pocket length.

61. The garment of claim 56, wherein the one or more pockets comprise at least three pockets.

62. The garment of claim 61, wherein the garment comprises a shirt, wherein the shirt comprises an upper back portion, a first shoulder portion and a second shoulder portion, wherein a first pocket is coupled to the first shoulder portion, a second pocket is coupled to the second shoulder portion, and a third pocket is coupled to the upper back portion.

63. The garment of claim 56 wherein each of the one or more pockets comprises an opening and an opening cover.

64. The garment of claim 63, wherein the opening is disposed along a top of the one or more pockets.

65. The garment of claim 63, wherein the opening is disposed along a side of the one or more pockets.

66. The garment of claim 63, wherein the opening cover comprises a cover layer of material overlapping the outer pocket portion.

67. The garment of claim 56, wherein the one or more pockets each comprise a closure mechanism.

68. The garment of claim 67, wherein the closure mechanism is selected from the group consisting of hook and loop connectors, zippers, buttons, snaps, and drawstrings.

69. The garment of claim 56, wherein the garment further comprises a cinching mechanism configured to cinch a section of the garment about a wearer's torso.

70. The garment of claim 69, wherein the cinching mechanism comprises a fastener selected from the group consisting of buttons, zippers, drawstrings, and hook and loop connectors.

71. The garment of claim 56, wherein each of the one or more pockets comprises a water absorbent lining.

72. The garment of claim 71, wherein the thermal adjustment layer comprises a thermally resistive material.

73. The garment of claim 56, wherein the garment comprises a surgical scrub shirt.

* * * * *